United States Patent [19]

Rusu et al.

[11] Patent Number: 4,824,099

[45] Date of Patent: Apr. 25, 1989

[54] ROTATING AMUSEMENT DEVICE

[75] Inventors: Robert T. Rusu; David O'Connor, both of Vancouver; Walter Cadwallader, Tsawwassen; Michael de Champlain, Vancouver; Ulf Ottho, Tsawwassen, all of Canada

[73] Assignee: Alpha Dynamics Corporation, Vancouver, Canada

[21] Appl. No.: 105,409

[22] Filed: Oct. 5, 1987

[51] Int. Cl.[4] ..... A63G 1/12

[52] U.S. Cl. ..... 272/33 R; 272/36; 272/132; 434/55

[58] Field of Search ..... 272/33 R, 36, 1 R, 1 C, 272/DIG. 4, 115, 109, 146, 49, 50, 132; 454/55, 57

[56] References Cited

U.S. PATENT DOCUMENTS

| | | | |
|---|---|---|---|
| 846,925 | 3/1907 | Kramer | 272/36 |
| 1,342,871 | 6/1920 | Ruggles | 272/36 X |
| 3,083,037 | 3/1963 | Gordon et al. | 272/115 X |
| 3,141,669 | 7/1964 | Chul | 272/36 X |
| 3,164,382 | 1/1965 | Johnson | 272/33 R |
| 4,133,250 | 9/1978 | Davis | 272/146 X |
| 4,240,623 | 12/1980 | Edwards | 272/33 R |
| 4,402,500 | 9/1983 | Coles | 272/33 R |

FOREIGN PATENT DOCUMENTS

| | | | |
|---|---|---|---|
| 1159660 | 2/1958 | France | 272/36 |

*Primary Examiner*—David A. Scherbel
*Assistant Examiner*—Richard E. Chilcot, Jr.
*Attorney, Agent, or Firm*—Christie, Parker & Hale

[57] ABSTRACT

A spinning and rotating seating amusement device is disclosed. It is comprised of a support stand having a base with pivotably mounted wheels, a crowd control barrier adapted to be removably secured to the support stand, a pair of upright members mounted on the support stand and at opposite ends thereof, a first ring supported by said upright members for rotation on an horizontal axis, a pair of support rings forming a frame and bisecting each other at right angles, the frame being supported by said first ring for rotation on a second axis at right angles to the horizontal axis, a pair of bisecting crossbars centrally positioned in the frame for receiving a seat, the seat having a securing system, bearings connecting the frame to the first ring and the first ring to the upright members, and hydraulic driving assemblies located at one of the upright members for rotating a first ring.

10 Claims, 8 Drawing Sheets

ROTATING AMUSEMENT DEVICE

FIELD OF THE INVENTION

This invention relates to amusement devices but more particularly to a spinning and rotating seating amusement device.

DESCRIPTION OF THE PRIOR ART

U.S. Pat. No. 4,402,500 which issued to Coles discloses a combined spinning and rotating amusement device for simulating weightlessness. It includes a circular base having upright spaced apart stanchions extensions between which is rotatably and spinnably mounted, a seat intended to be occupied by the user. The spinning and rotating means includes a rotatable portion mounted between the extensions by joints intended to permit rotation about an horizontal axis while the spinnable portion is rotatably mounted on the rotating portion so as to rotate via joints about an axis normal to the axis of rotation of the rotatable portion.

It was found that because of the large number of interactive forces, such as gyroscopic and centrifugal forces acting on the rings, the aforementioned device tended to wobble and move around considerably in view of the vibrations being created.

In addition, control of the speed of rotation of the rings were made difficult in view of the lack of a mechanical brake mechanism to allow the user to manually operate and control the rotation of the device. Also, it was found the device became relatively unsafe in view of the close proximity of the rotating rings to the seat. At high rotational speed, the loss of grip by the user of the center or spinning rings could lead to injury.

Therefore there exists a requirement for an improved spinning and rotating seating amusement device which is safer to use and less likely to cause injury to the user.

Accordingly, an object of the present invention is to provide an improved and spinning seating amusement device which is completely stable and free of vibration.

Another object of the present invention is to provide an improved spinning and rotating seating amusement device which is hydraulically driven.

Yet another object of the present invention is to provide an improved spinning and rotating seating amusement device which provides a safer and more comfortable seating arrangement for the user.

SUMMARY OF THE INVENTION

According to an aspect of the present invention, there is provided a spinning and rotating seating amusement device, comprising:

a support stand having a base with pivotably mounted wheels;

a crowd control means adapted to be removably secured to said support stand;

a pair of upright members mounted on said support stand and at opposite ends thereof;

a first ring supported by said upright members for rotation on an horizontal axis;

a pair of support rings forming a frame and bisecting each other at right angles, said frame being supported by said first ring for rotation on a second axis at right angles to said horizontal axis;

a pair of bisecting crossbars centrally positioned in said frame for receiving a seat, said seat having means for securing a passenger thereon;

bearing means connecting said frame to said first ring and said first ring to said upright members; and hydraulic driving means located at one of said upright members for rotating said first ring.

DESCRIPTION OF THE DRAWINGS

Particular embodiments of the invention will be understood in conjunction with the accompanying drawings in which.

DESCRIPTION OF THE PREFERRED EMBODIMENTS

Figure 1:
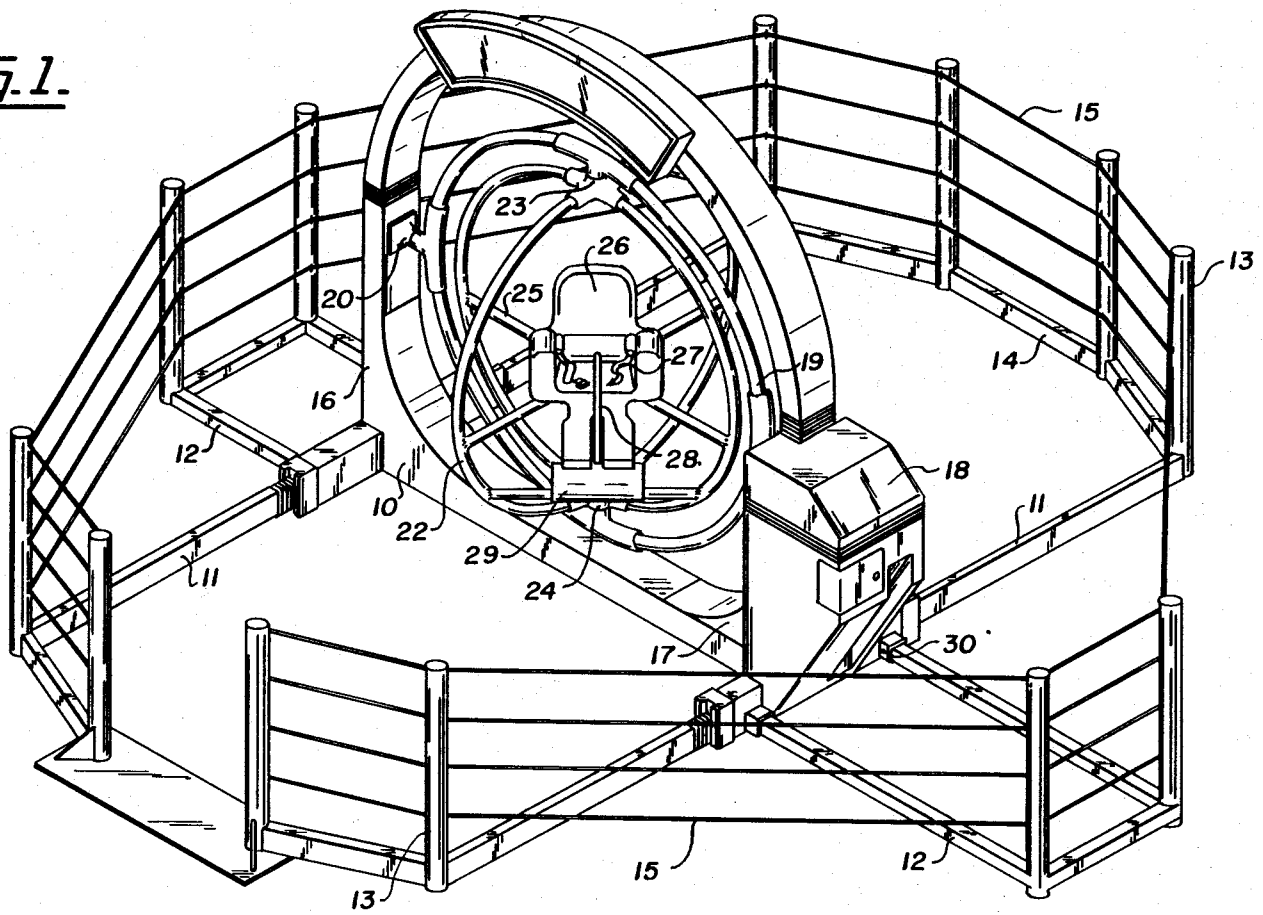
FIG. 1 is a isometric view a complete amusement device according to the present invention.

Referring now to FIG. 1, we have shown a fully assembled spinning and rotating seating amusement device according to the present invention. The amusement device is basically comprised of a support stand 10 having a number of pivotably mounted front and rear support members 11 and side support members 12. A number of crowd control stanchions 13 are located at the distal ends of the support members 11 and 12. An additional set of extensions 14 are positioned between rearward support members 11 to form with crowd control cables 15, an enclosure defining a safety area.

On each side of support stand 10 is provided a pair of upright members 16 and 17. A control and hydraulic driving mechanism assembly 18 is provided at upright member 17. The assembly is used to rotate ring 19.

Figure 2:
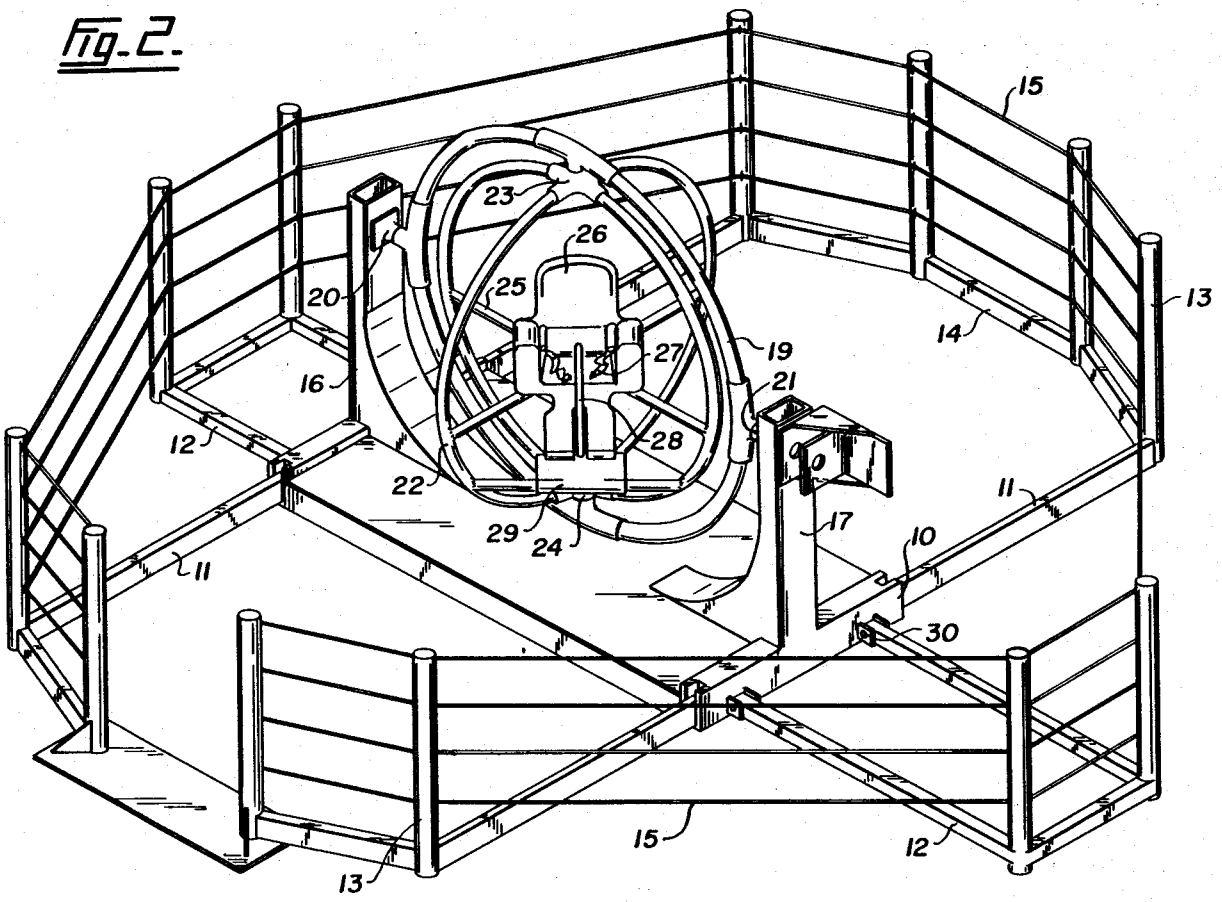
FIG. 2 is a isometric view of a partially assembly amusement device.

As more clearly shown in FIG. 2, ring 19 is pivotably mounted to upright members 16 and 17 by means of pivotable joints 20 and 21 respectively.

Joints 20 and 21 allow ring 19 to rotate about an horizontal axis defined by the joints. Centrally located within ring 19 is a pair of support rings 22 forming a frame and bisecting each other at right angles. The frame is supported to ring 19 by means of pivotable joints 23 and 24. Frame 22 rotate on a second axis which lies at right angles to the horizontal axis defined by joints 20 and 21. A pair of bisecting crossbars 25 is centrally located within frame 22 and is adapted to receive a passenger seat 26. Securing means is provided to safely hold a passenger on seat 26. The securing means is comprised of a seatbelt 27, a body hold-down assembly 28 and a foot guard 29. As can be seen more clearly in FIG. 2, side stabilizing bars 12 are hingedly mounted to frame 10 by means of a removable pin 30 which allows the disassembly of the crowd control extensions.

Figure 3B:
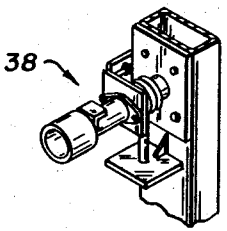
FIGS. 3*a* and 3*b* are isometric views of the hydraulic driving means according to a first and second embodiment of the invention.
Figure 3A:
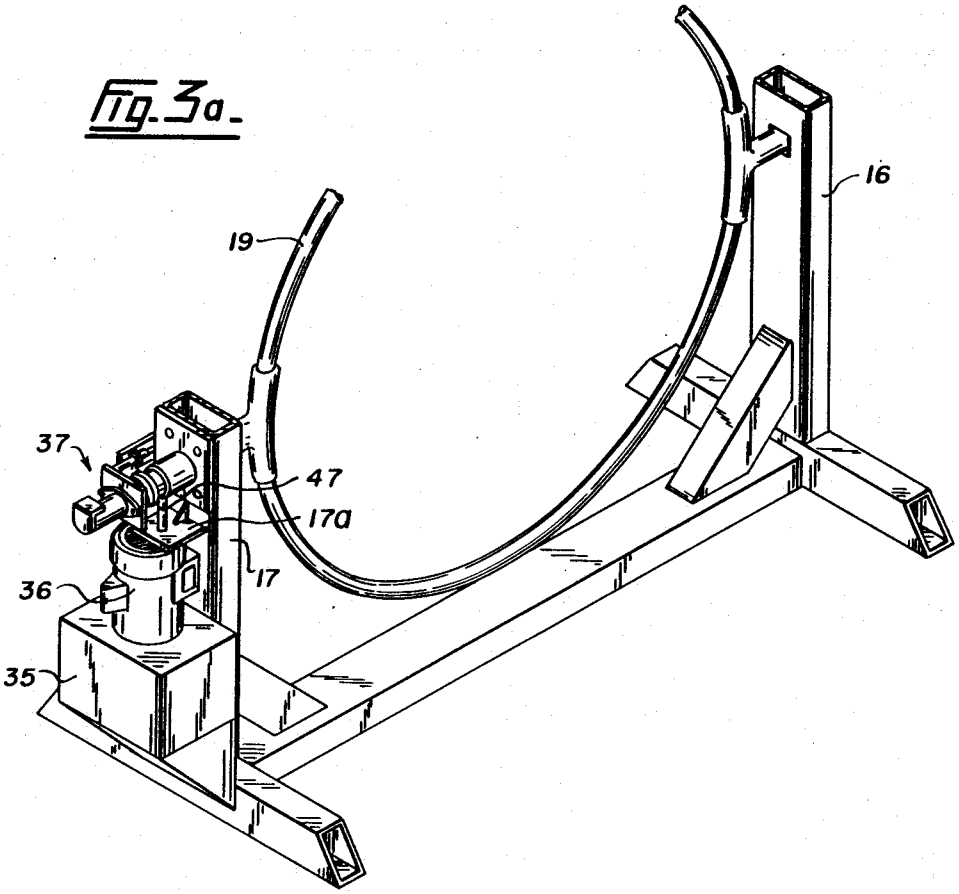

Referring now to FIGS. 3*a* and 3*b*, we have shown a first and second embodiment of the driving mechanism of the present invention. The basic hydraulic driving system is comprised of a fluid reservoir 35, a hydraulic 36 and hydraulic drive assembly 37. The hydraulic drive assembly 37 is securely mounted to upright member 17 and is adapted to rotate ring 19 at a predetermined speed.

The hydraulic assembly 38 shown in FIG. 3*b* is a modified version of the hydraulic assembly 37 of FIG. 3*a* as will be further described below.

Figure 4:
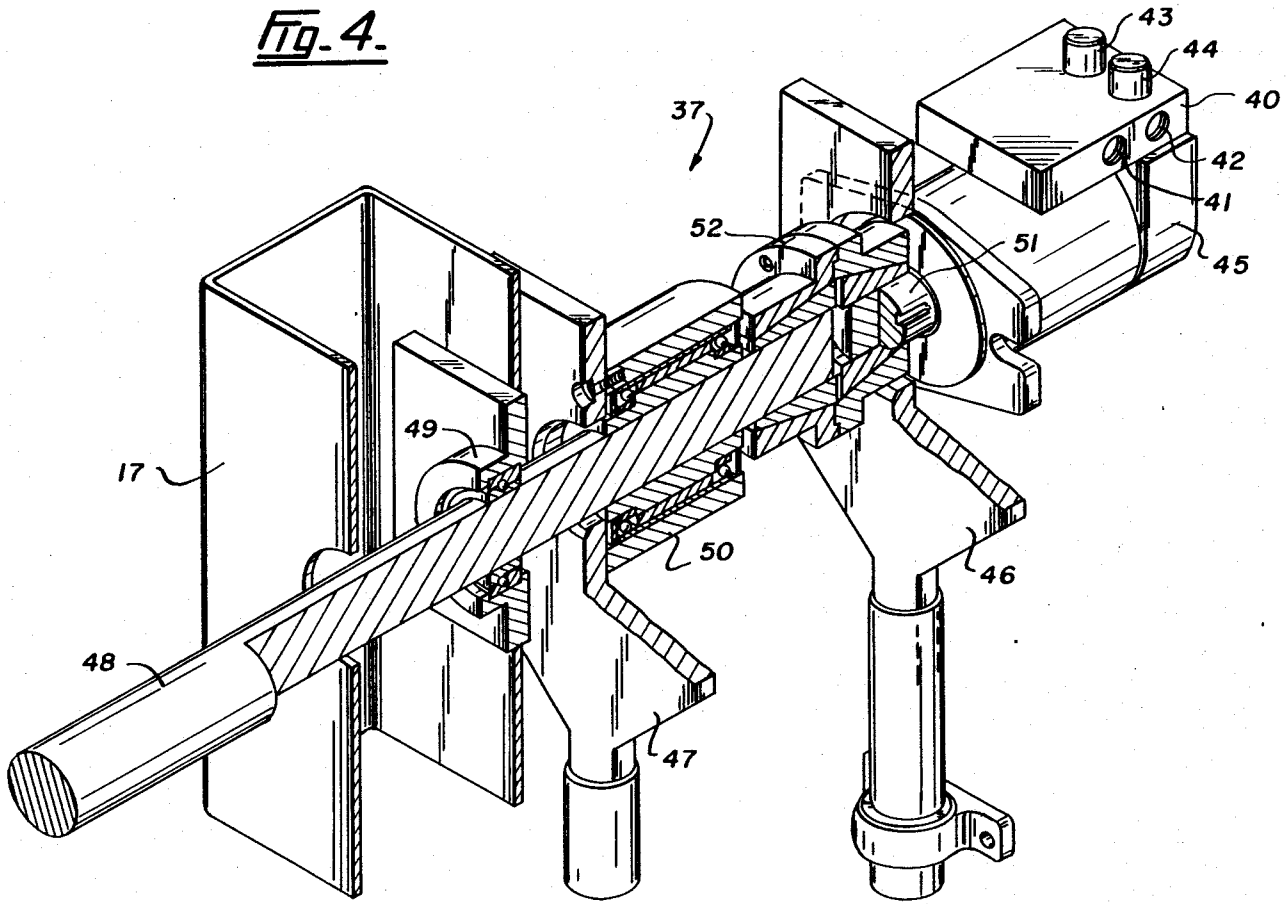
FIG. 4 is a partially sectioned view of the hydraulic means of FIG. 3*a;*

Referring now to FIG. 4, we have shown a partially sectioned view of the hydraulic drive assembly 37 shown in FIG. 3*a*. The assembly is basically comprised of a manifold 40 having fluid inlet 41 and outlet 42 and a pair of counter balanced valves 43 and 44. Below manifold 40 is provided a hydraulic motor 45 adapted to receive fluid from and to pass fluid to manifold 40. The assembly is supported on upright member 17 by means a pair of torque plates 46 and 47 lying adjacent upright member 17 and contacting plate 17*a* attached to member 17. A driving shaft 48 is supported onto upright member 17 by means of a flange bearing 49. Shaft 48 extends therethrough and is supported onto torque plate 47 by means of a cam clutch 50. Shaft 48 is then mechanically connected to output shaft 51 of hydraulic motor 45 by means of a tapered lock flange 52.

Figure 5:
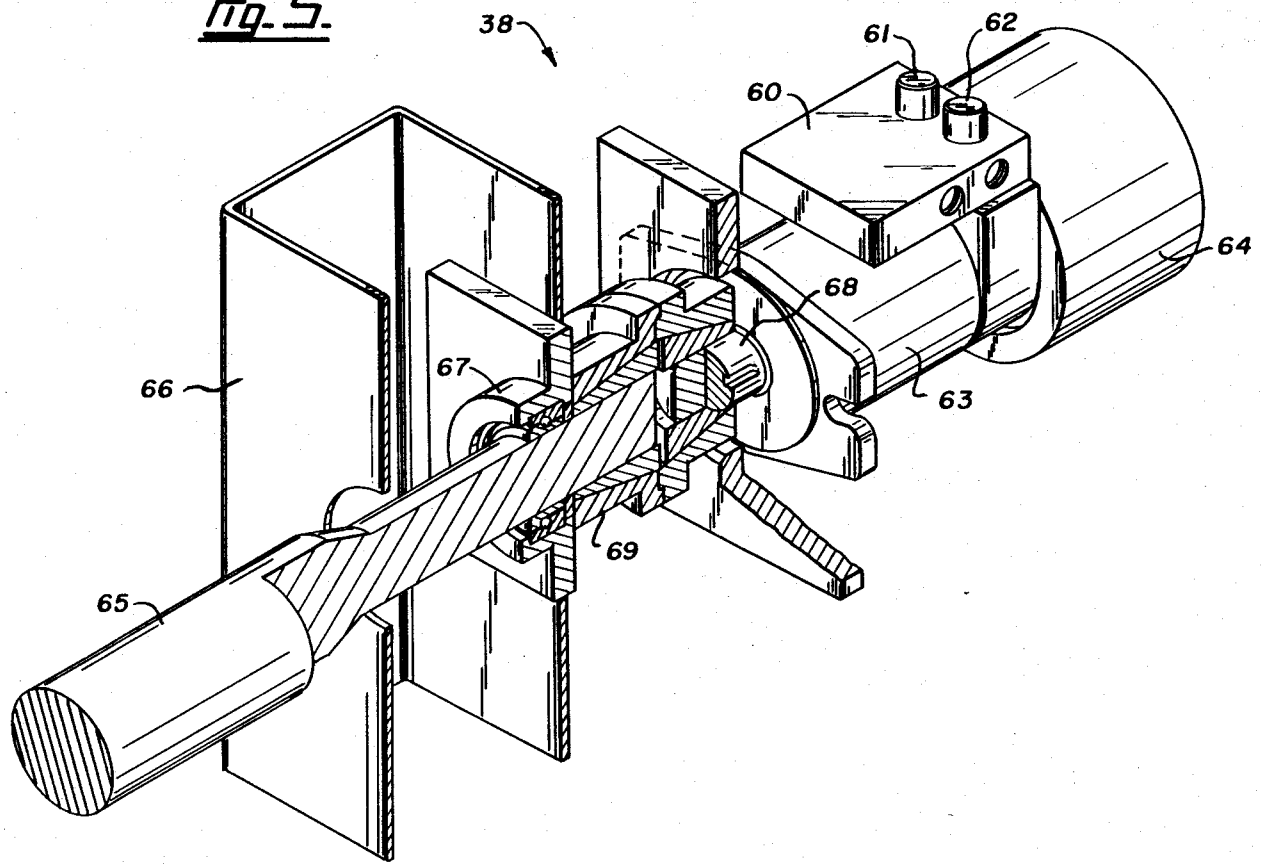
FIG. 5 is a partially sectioned view of the hydraulic means of FIG. 3*b;*

In the embodiment of FIG. 5, an hydraulic drive and brake assembly, shown generally in FIG. 3*b*, is shown partially sectioned. The assembly is similarly comprised with a manifold 60, a pair of counter-balanced valves 61 and 62 and a hydraulic motor 63. However, in this embodiment, a cam clutch 64 is attached to hydraulic motor 63.

Similarly, shaft 65 is supported onto an upright member 66 by means of a flange bearing 67. Shaft 65 is mechanically linked to output shaft 68 of pump 63 by means of a tapered lock flange 69.

Figure 6:
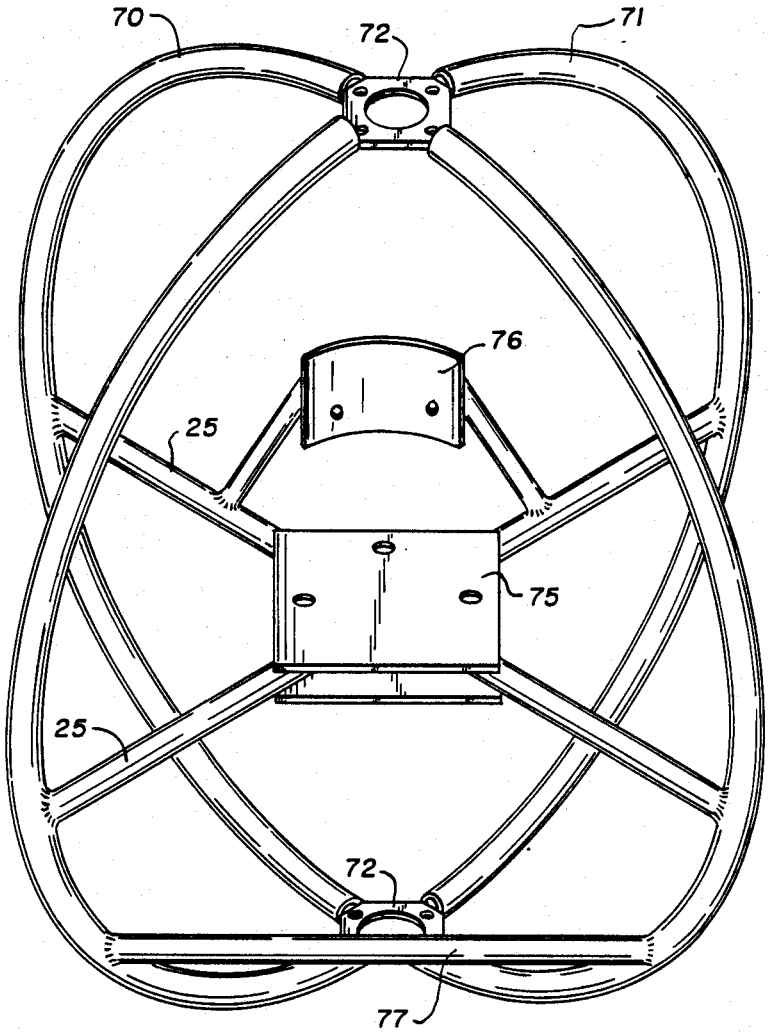
FIG. 6 is an isometric view of the cage assembly used in supporting the user.

Referring now to FIG. 6, we have shown an isometric view of the support rings forming a frame or seat carriage assembly. The assembly is comprised of a first and second ring 70 and 71 bisecting each other at right angles. A tube centering plate 72 is provided at the bisecting point and is used to support the cage assembly within ring 19 as shown in FIGS. 1 and 2.

The pair of crossbars 25 bisect each other at right angles and are fixedly mounted to rings 70 and 71 respectively. A bottom plate 75 is fixedly mounted at the bisecting point of crossbars 73 and 74 and is adapted to receive the passenger seat. A back plate 76 improves the overall structural integrity of the seat support arrangement. A third crossbar 77 extends laterally in the frontal section of the cage assembly between ring 70 and ring 71. Crossbar 77 is used to support the foot guard forming part of the passenger seat.

Figure 7:
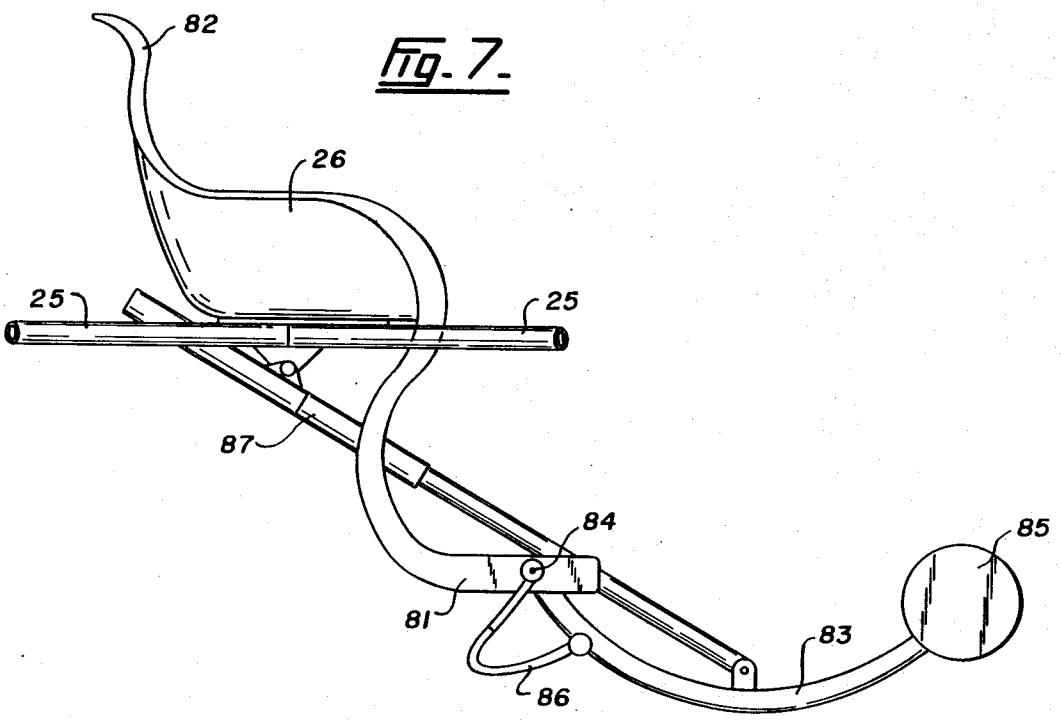
FIG. 7 is an illustrative side view of the seat arrangement.

Referring now to FIG. 7 we have shown a side view of the passenger seat assembly using the amusement device of the present invention. It is basically comprised of a seat 26 having a foot support 81 and a back rest 82. A body hold down assembly 83 is pivotably mounted to foot rest 81 at pivot point 84. The body hold down assembly is comprised of a lap securing pad 85 onto which can be provided a pair of handles and a foot guard 86. A piston assembly 87 is provided between seat 26 and body hold down assembly 83 and permits the easy opening and closing of the body hold down assembly when a passenger is seated. The seat and body hold down assembly are entirely supported onto crossbars 25.

Figure 8:
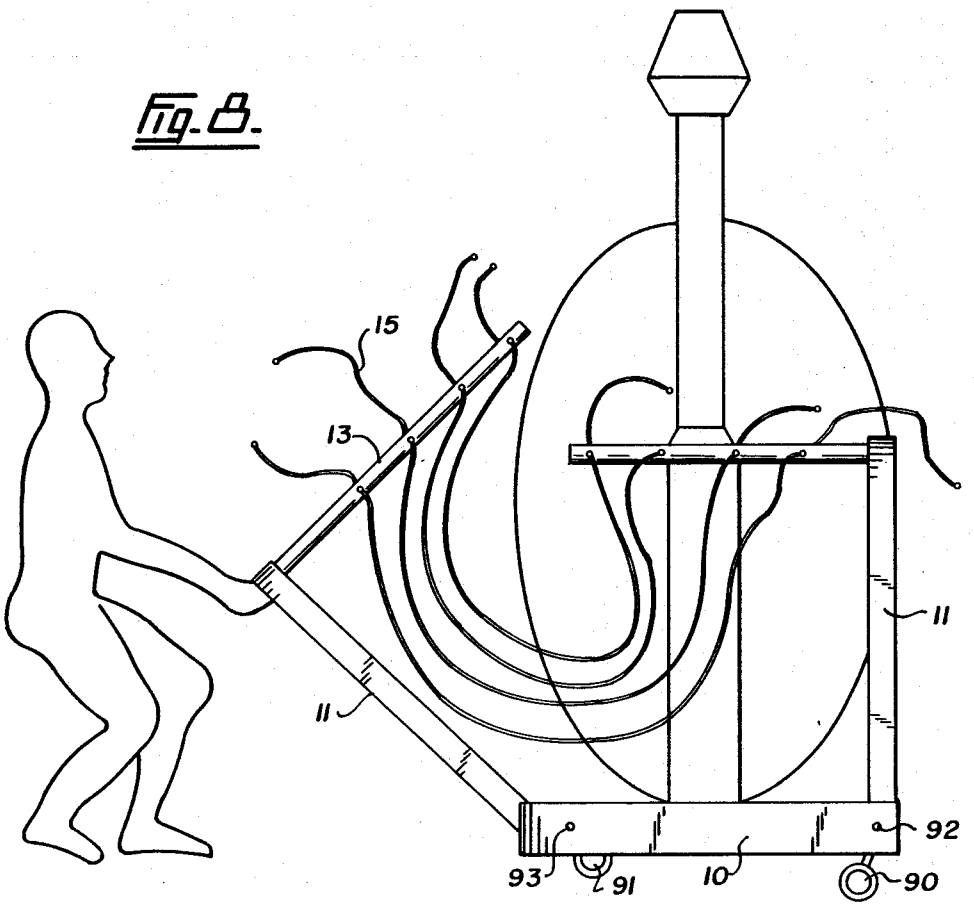
FIG. 8 is an illustrative view of the amusement device in a transport mode.

Referring now to FIG. 8, we have shown an illustrative diagram of the improved amusement device of the present invention in the transport mode. As can be seen, when front and rear support members 11 and side support members 12 are pivoted, a set of wheels 90 and 91 become disengaged from under base 10 to allow easy transportation of the amusement device. Each support member and its corresponding wheel is pivotably mounted about a pivot point 92 and 93.

We claim:

1. A spinning and rotating seating amusement device, comprising:

a support stand having a base with pivotably mounted wheels;

crowd control means secured to said support stand;

a pair of upright members mounted on said support stand and at opposite ends thereof;

a first ring supported by said upright members for rotation on an horizontal axis;

a pair of support rings forming a frame and bisecting each other at right angles, said frame being supported by said first ring for rotation on a second axis at right angles to said horizontal axis;

a pair of bisecting crossbars centrally positioned in said frame for receiving a seat, said seat having means for securing a passenger thereon;

bearing means connecting said frame to said first ring and said first ring to said upright members; and hydraulic driving means located at one of said upright members for rotating said first ring.

2. An amusement device as defined in claim 1 wherein said crowd control means comprises a series of upright stanchions defining a space around said stand, said stanchions being joined together by means of cables.

3. An amusement device as defined in claim 1 wherein said hydraulic driving means comprises a fluid container, a hydraulic pump and an hydraulic driving assembly.

4. An amusement device as claimed in claim 3 wherein said hydraulic driving assembly is comprised of a manifold having fluid inlet and outlet means and a pair of power balanced valves thereon, said manifold being connected to the hydraulic pump, said pump being adapted to pump fluid in and out of said manifold, a hydraulic motor have an output shaft mechanically linked to a driving shaft by means of a taper lock flange, said driving shaft being supported by means of torque plates lying adjacent to at least one of said upright members, said driving shaft being supported by said upright member by means of a flange bearing and by means of a cam clutch.

5. An amusement device as defined in claim 3 wherein said hydraulic driving assembly in comprised of a manifold having fluid inlet and outlet, a pair of counter balanced valves, a hydraulic motor connecting a first shaft to a driving shaft by means of a tapered lock flange, said motor being mechanically linked to a cam clutch.

6. An improved amusement device as defined in claim 1 wherein said seat securing means comprises a seat belt, a body hold-down assembly and a foot guard.

7. An amusement device as defined in claim 6 wherein said seat is comprised of a foot support and a backrest, said body hold-down assembly being pivotably mounted to said foot rest at a pivot point.

8. An improved amusement device as defined in claim 7 wherein said body hold-down assembly is comprised of a lap securing pad onto which is provided a pair of handles, and a foot guard.

9. An amusement device as defined in claim 7 wherein said body hold-down assembly further comprises a piston assembly provided between said seat and said body hold-down assembly to permit easy opening and closing of said assembly when a passenger is seated.

10. An improved amusement device as defined in claim 1 wherein said pivotably mounted wheels are recessed in said base and connected to a pair of support members extending outwardly from said stand and pivotably mounted thereto, such that when said members are pivoted upwardly, said wheels will pivot downwardly to support said stand.

* * * * *

UNITED STATES PATENT AND TRADEMARK OFFICE

CERTIFICATE OF CORRECTION

PATENT NO. : 4,824,099

DATED : April 25, 1989

INVENTOR(S) : R. Rusu; D. O'Connor; W. Cadwallader; U. Ottho

It is certified that error appears in the above-identified patent and that said Letters Patent is hereby corrected as shown below:

On the Front Page:

Abstract, line 7, change "said" to -- the --.
Abstract, line 7, change "an" to -- a --.
Abstract, line 10, change "said" to -- the --.

In the Specification:

Column 1, line 13, change "stanchions" to -- stanchion --.
Column 1, line 18, before "horizontal" change "an" to -- a --.
Column 1, line 61, before "horizontal" change "an" to -- a --.

Column 2, line 10, before "isometric" change "a" to -- an --.
Column 2, line 12, before "isometric" change "a" to -- an --.
Column 2, line 12, change "assembly" to -- assembled --.
Column 2, line 48, after "about" change "an" to -- a --.
Column 2, line 53, change "rotate" to -- rotates --.
Column 2, line 59, change "seatbelt" to -- seat belt --.

Column 3, line 16, before "a" insert -- of --.
Column 3, line 18, change "onto" to -- to --.
Column 3, line 20, change "onto" to -- on --.
Column 3, line 24, change "an" to -- a --.
Column 3, line 33, change "pump" to -- motor --.

UNITED STATES PATENT AND TRADEMARK OFFICE

CERTIFICATE OF CORRECTION

PATENT NO. : 4,824,099

DATED : April 25, 1989

INVENTOR(S) : R. Rusu; D. O'Connor; W. Cadwallader; U. Ottho

It is certified that error appears in the above-identified patent and that said Letters Patent is hereby corrected as shown below:

In the Claims

Column 4, line 16, before "horizontal"change "an" to -- a --.
Column 4, line 36, before "hydraulic" change "an" to -- a --.
Column 4, line 44, after "motor" delete "having"
Column 4, line 52, change "in" to -- is --.

Signed and Sealed this

Thirteenth Day of March, 1990

*Attest:*

JEFFREY M. SAMUELS

*Attesting Officer*

*Acting Commissioner of Patents and Trademarks*